US007225489B1

(12) United States Patent
Frickey et al.

(10) Patent No.: US 7,225,489 B1
(45) Date of Patent: Jun. 5, 2007

(54) EXPANDABLE SEAMLESS MATTRESS ASSEMBLY

(75) Inventors: Bradley K. Frickey, Ellis, KS (US); Brian K. Frickey, Ellis, KS (US); Cory Eberle, Ellis, KS (US)

(73) Assignee: Sunflower Medical, L.L.C., Ellis, KS (US)

( * ) Notice: Subject to any disclaimer, the term of this patent is extended or adjusted under 35 U.S.C. 154(b) by 0 days.

(21) Appl. No.: 11/379,263

(22) Filed: Apr. 19, 2006

(51) Int. Cl.
*A47C 27/15* (2006.01)

(52) U.S. Cl. ..... 5/723; 5/722; 5/690

(58) Field of Classification Search ..... 5/723, 5/722, 661, 690, 740, 922
See application file for complete search history.

(56) References Cited

U.S. PATENT DOCUMENTS

| | | | | |
|---|---|---|---|---|
| 1,933,342 | A * | 10/1933 | Salter | 5/722 |
| 2,271,601 | A | 2/1942 | Miller | |
| 2,883,683 | A | 4/1959 | Burk | |
| 3,058,126 | A * | 10/1962 | Fleming et al. | 5/722 |
| 3,308,492 | A | 3/1967 | Lovette | |
| 4,271,547 | A | 6/1981 | Grossutti | |
| 5,214,809 | A | 6/1993 | Stuart | |
| 5,701,620 | A | 12/1997 | Montross | |
| 5,724,685 | A * | 3/1998 | Weismiller et al. | 5/600 |
| 5,745,936 | A | 5/1998 | Van Cutchen | |
| 5,953,779 | A | 9/1999 | Schwartz | |
| 6,047,422 | A | 4/2000 | Yousif | |
| 6,324,709 | B1 | 12/2001 | Ikeda et al. | |
| 6,357,065 | B1 | 3/2002 | Adams | |
| 6,499,167 | B1 * | 12/2002 | Ellis et al. | 5/727 |
| 6,510,571 | B1 | 1/2003 | Tittle | |
| 6,557,198 | B1 | 5/2003 | Gladney et al. | |
| 6,588,035 | B2 | 7/2003 | LeDuc | |
| 2002/0148043 | A1 | 10/2002 | Le Duc et al. | |
| 2003/0028970 | A1 | 2/2003 | Gladney | |

* cited by examiner

*Primary Examiner*—Alexander Grosz
(74) *Attorney, Agent, or Firm*—Spencer, Fane, Britt & Browne, LLP

(57) ABSTRACT

The present invention encompasses a mattress (20) for a variable width bed. The mattress (20) has a top section (40) positioned on a base section (50, 60) with the top section (40) having a width greater than the width of the base section (50, 60), so that wing portions of the top section (40) extend beyond the sides of the base section (50, 60). The top section (40) may also have a pair of relief notches (140) defined therein with one relief notch (140) positioned generally above each side of the base section (50, 60). The mattress (20) cooperates with one or more expansion members (30) that are sized so that when placed at the side of the base section (50, 60) and below the wing portion of the top section (40) the sleeping surface of the mattress (20) will be substantially flat and substantially seam and crease free.

20 Claims, 3 Drawing Sheets

EXPANDABLE SEAMLESS MATTRESS ASSEMBLY

BACKGROUND OF THE INVENTION

The present invention relates generally to mattresses. More specifically, the present invention relates to expandable seamless mattresses for variable width beds for use with bariatric patients.

Variable width beds, that is beds that are adjustable between a narrow width and a wide width, are employed in many circumstances. For example, a bariatric bed is designed to support an obese person and, therefore, generally will have a wide width to accommodate the patient. A bariatric bed, however, must be able to move through a standard doorway in an emergency situation or when an obese patient is unable to move themselves. Therefore, bariatric beds often are variable width beds in order to permit patient transport. Variable width beds are also utilized in many hospitals and nursing homes to allow these institutions to accommodate patients and/or residents of all sizes. In this manner, the hospitals and nursing homes are able to conserve valuable resources, for example, by not having to reserve rooms only for large persons.

Utilizing a variable width bed at its wide width requires either multiple mattresses or a narrow mattress that can be expanded to a wide width. If multiple mattresses are employed, the mattresses must be swapped when the width of the bed is changed. If the bed is occupied, however, this swapping process is difficult at best. Thus, it is often better to expand a narrow mattress to a wide width. Generally, expanding a narrow mattress to a wide width is accomplished by placing one or more expansion members beside the mattress. Unfortunately, utilizing an expansion member alone creates a seam where the expansion member abuts the mattress, and over time, this seam becomes uncomfortable and may lead to bed sores and other physical problems.

Accordingly, it is desirable to provide an improved expandable mattress and mattress assembly that provide a seamless, smooth sleeping surface in both a narrow width and an expanded width.

BRIEF SUMMARY OF THE INVENTION

There is, therefore, provided in the practice of the invention a mattress for a variable width bed comprising a top section and a base section. The top section has a width greater than the width of the base section, so that a wing portion of the top section extends beyond a side of the base section. The top section also has a relief notch defined therein and positioned generally above a side of the base section.

In another embodiment of the invention, there is provided a mattress assembly for a variable width bed comprising a mattress and an expansion member. The mattress has a top section positioned on a base section with the top section having a width greater than the width of the base section, so that a wing portion of the top section extends beyond the side of the base section. The expansion member is positionable at the side of the base section and below the wing portion of the top section and sized so that when in place the sleeping surface of the mattress is substantially flat and substantially seam free.

In yet another embodiment, the present invention provides a mattress for a variable width bed comprising a top section over a base section. The top section has a width greater than the width of the base section, so that wing portions of the top section are extendable beyond the sides of the base section to present a sleeping surface substantially without seams and having a width substantially the width of the top section. The wing portions are foldable to present a sleeping surface substantially without seams and having a width substantially the width of the base section.

BRIEF DESCRIPTION OF THE DRAWINGS

Further features of the present invention will become apparent to those skilled in the art to which the present invention relates from reading the following description with reference to the accompanying drawings, in which.

DETAILED DESCRIPTION OF THE INVENTION

Figure 1:
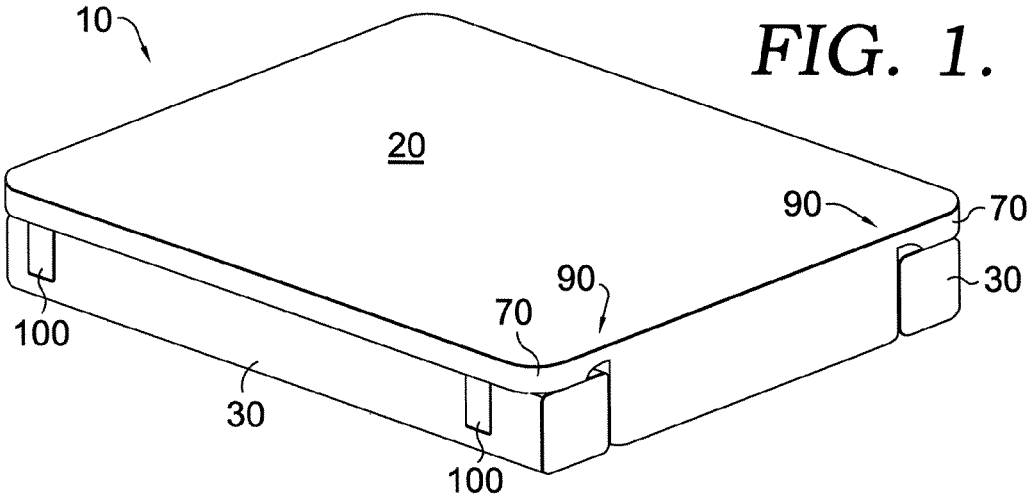
FIG. 1 is a perspective view of a mattress assembly according to one embodiment of the present invention.

The present invention includes an expandable mattress for a variable width bed that presents a substantially seamless, crease free, and smooth sleeping surface in both a narrow width and an expanded width. The invention will now be described with reference to the drawing figures, in which like reference numerals refer to like parts throughout. For purposes of clarity in illustrating the characteristics of the present invention, proportional relationships of the elements have not necessarily been maintained in the drawings. Instead, the sizes of certain small components have been exaggerated for illustration. Moreover, it is to be understood that the phraseology and terminology employed herein, as well as in the abstract, are for the purpose of description and should not be regarded as limiting.

Figure 2:
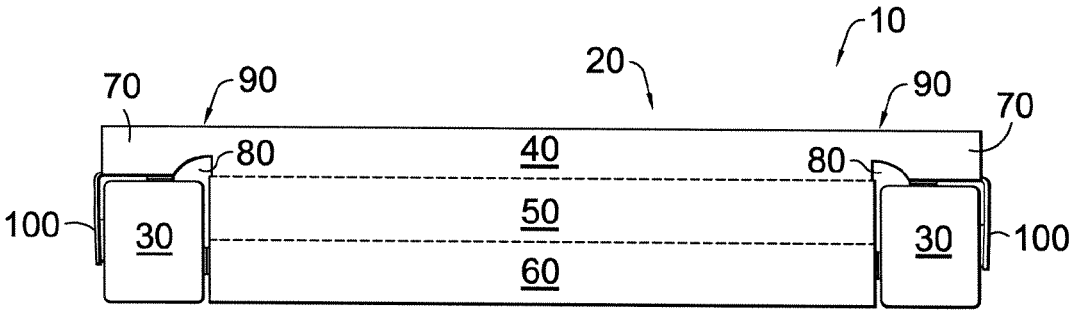
FIG. 2 is a front view of the mattress assembly of FIG. 1 and includes dashed lines showing the material layers of the mattress according to one embodiment of the present invention.
Figure 4:
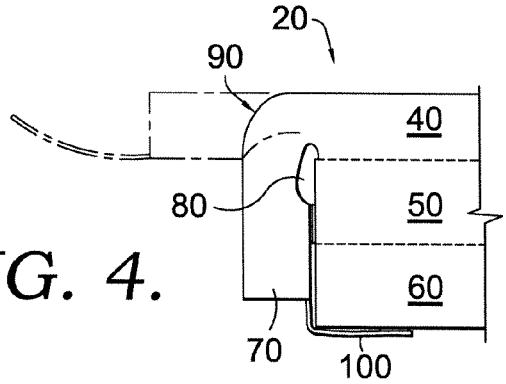
FIG. 4 is a front view of one side of the mattress from the mattress assembly of FIG. 2 with the overhanging portion of the mattress top section turned down so the mattress has a narrow width and having a dashed line showing the overhanging portion extended laterally.
Figure 5:
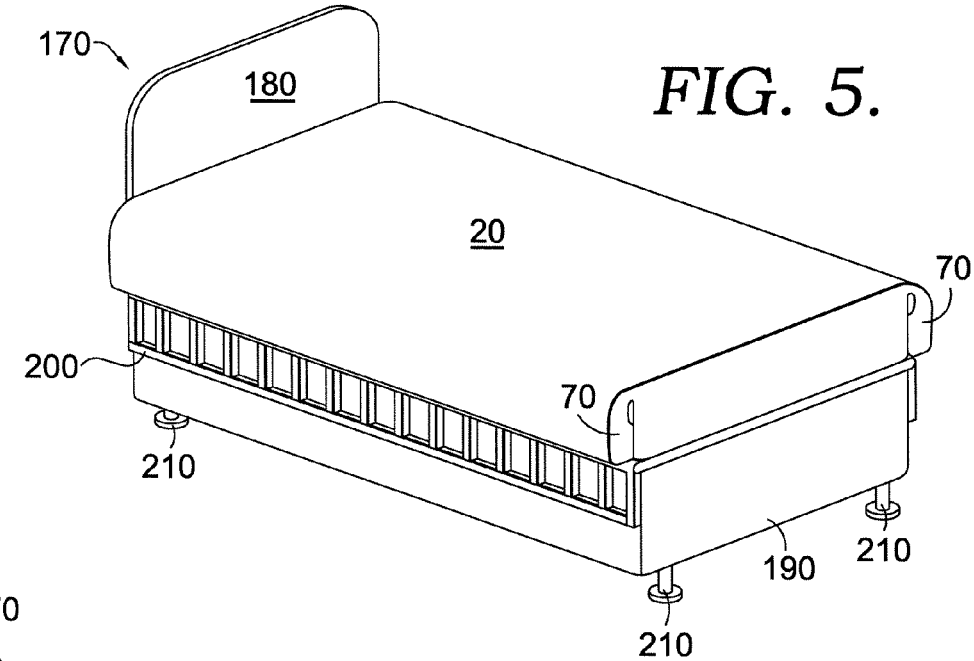
FIG. 5 is a perspective view of a mattress from a mattress assembly according to one embodiment of the present invention arranged in a narrow width and installed on a bed.
Figure 6:
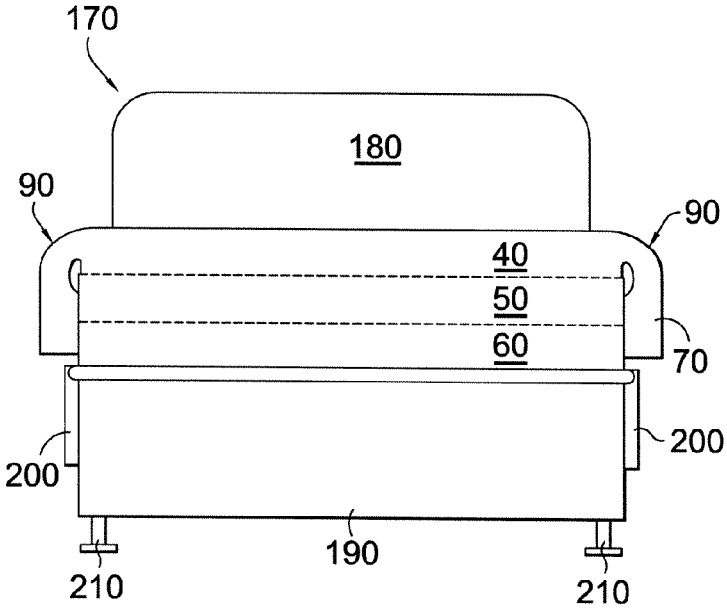
FIG. 6 is a front view of the mattress and bed of FIG. 5 and includes dashed lines showing material layers of the mattress according to one embodiment of the present invention.
Figure 7:
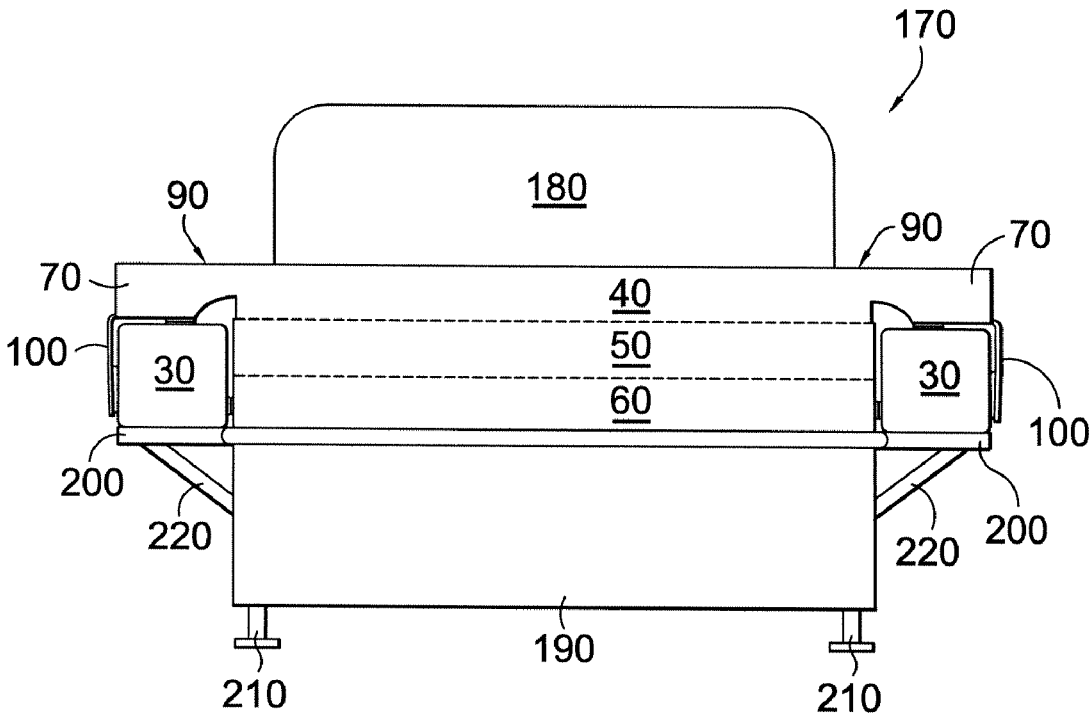
FIG. 7 is a front view of the mattress assembly of FIG. 2 installed on a bed.

Turning now to the drawings, FIG. 1 shows a mattress assembly 10 according to one embodiment of the present invention. Generally, the mattress assembly 10 includes a mattress 20 and a pair of expansion members 30. With the expansion members 30 in place on either side of the mattress 20 as shown in FIGS. 1, 2, and 7, the sleeping surface of the mattress 20 has a wide width. When the expansion members 30 are removed, as shown in FIGS. 4, 5, and 6, the sleeping surface of the mattress 20 has a narrow width. In either case, the top sleeping surface of the mattress 20 is substantially flat and seamless.

With additional reference to FIG. 2, the mattress 20 includes a top section positioned on a base section. In this embodiment of the present invention, the top section includes a single top layer 40 and the base section comprises a first base layer 50 and a second base layer 60. As can be seen, the layers 40, 50, 60 are associated together to form a single T-shaped mattress component. Though the embodiment shown utilizes multiple components to form the T-shaped mattress thereby allowing the use of different materials for the various mattress components, the T-shaped mattress could also be formed with a unitary construction.

Continuing with FIG. 2, it may also be seen that the top layer 40 has a greater width than the base layers 50, 60, which have substantially the same width. Because of its greater width, a wing portion 70 of the top layer 40 extends beyond the sides of the base layers 50, 60. It should be understood that the top surface of the top layer 40 is the sleeping surface of the mattress 20 both when the mattress 20 has a narrow width and when it has a wide width, and therefore, there are no seams in the sleeping surface in either width.

In one embodiment of the present invention, the base layers 50, 60 are approximately 36 inches wide and the top layer 40 is approximately 48 inches wide and approximately 1.5 inches thick. The expansion members 30 in this embodiment are approximately 6 inches wide so as to fit beneath the wing portion 70 of the top layer 40 extending beyond the side of the base section. With these dimensions, when the expansion members 30 are in place the sleeping surface of the mattress 20 is substantially the width of a standard full size bed, and when the expansion members 30 are removed the sleeping surface of the mattress 20 is substantially the width of a standard twin mattress. Of course, it should be understood that the mattress layers 40, 50, 60 and expansion members 30 may have other, wider or narrower widths and thicknesses.

In one embodiment, the mattress layers 40, 50, 60 and expansion members 30 are filled with foam material, such as a viscoelastic, polyurethane, or latex foam. For example, in one embodiment, the top layer 40 is filled with a viscoelastic foam and the base layers 50, 60 are filled with a polyurethane foam with the second base layer 60 having a more resistant foam material then the first base layer 50. It should be understood that other suitable natural (e.g. down or cotton) or synthetic (e.g. polyester or plastic) material or even water or air will also suffice to fill the mattress layers 40, 50, 60 and expansion members 30. Moreover, the mattress 20 with its multiple layers may have a combination of different fill material.

Figure 3:
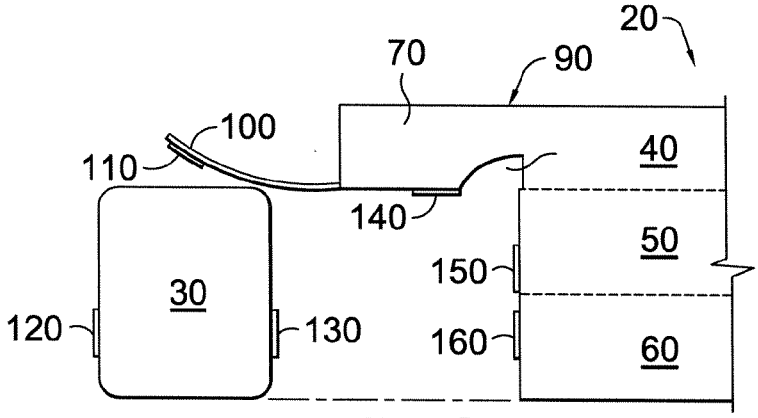
FIG. 3 is a front view of one side of the mattress assembly of FIG. 2 with the expansion member disengaged and moved laterally.

As best seen in FIGS. 3 and 4, in this embodiment, the top layer 40 of mattress 20 defines a relief notch 80 positioned generally adjacent and above each side of the base sections 50, 60. Alternatively, the relief notch 80 is formed in the top of the base section at the hinge area 90 of the expandable wing portion 70. In this embodiment of the present invention, the relief notch 80 has a substantially half parabolic cross section when the top layer 40 extends substantially horizontally, such as when the expansion members 30 are in place to provide a wide sleeping surface. The presence of the relief notch 80 facilitates the turning or folding down of the wing portions 70 of the top layer 40 in order to provide a narrower sleeping surface. Without a relief notch 80, when the wing portions 70 of the top layer 40 are turned down, the material of the top layer 40 would resist the action in the hinge area 90 of the top layer 40. This resistance would make the turning down action more difficult to perform and would make it more difficult for the wing portions 70 of the top layer 40 to lay flat against the side of the base layers 50, 60. Further, the absence of the relief notch 80 may cause the material in the hinge area 90 to stretch and thereby develop creases over time as the mattress is used. It should be understood that the relief notch 80 may have a number of different cross sections, for example a quarter circle or a right triangle, when the top layer 40 is extended horizontally. It should also be understood that the expansion members 30 also may be shaped to conform to and thereby substantially fill the relief notch.

The mattress 20 in this embodiment also includes a pair of flaps 100 extending from each side of the top layer 40 for a total of four flaps. Additionally, as seen best in FIG. 3, each flap 100 includes a flap fastener 110 located on the underside of the flap 100 and towards its outer end. Continuing with FIG. 3, the expansion members 30 also have member fasteners 120, 130 positioned on each side of the member 30 and towards its lower end. The mattress 20 also includes a number of fasteners 140, 150, 160, with a top fastener 140 positioned on the underside of the wing portion of top layer 40 and two base fasteners 150, 160 positioned on the side of the base layers 50, 60. It should be understood that the individual fasteners can be part of any number of fastener assemblies, such as a hook and loop assembly, a snap, clip or belt and buckle assembly.

Figure 8:
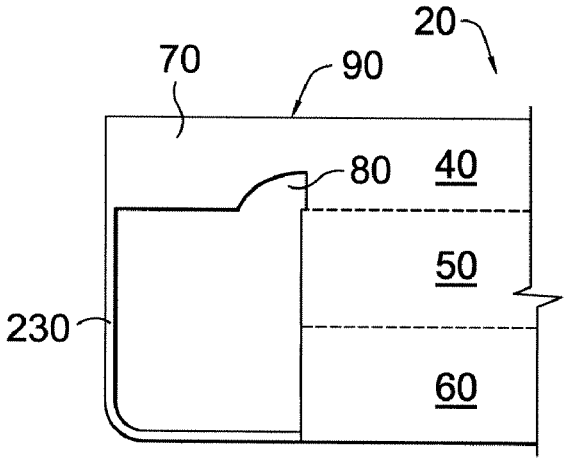
FIG. 8 is a front view of one side of the mattress assembly according to another embodiment of the present invention.

Turning to FIG. 8, in another embodiment of the present invention, instead of a flap 100, a strap 230 extends from the outer edge of the underside of the wing portion 70 to the lower end of the side of second base layer 60 in such a manner as to accommodate an expansion member 30. The mattress 20 may have multiple straps 230 (similar to the multiple flaps 100) or it may have a single strap that extends the length of the mattress 20 to form a sleeve.

FIGS. 5 and 6 show a mattress 20 from a mattress assembly 10 of the present invention installed on a variable width bed 170 set up for a narrow width. The bed 170 includes a headboard 180, a base section 190, a pair of extensions 200, and a number of feet 210. As can be seen, for this narrow width bed configuration, the outer portions of top layer 40 are folded down and lay flat against the sides of the base layers 50, 60. Referring additionally to FIGS. 3 and 4, when the wing portion 70 of the top layer 40 is turned down into its retracted position, the top fastener 140 positioned on the underside of the top layer 40 cooperates with the base fastener 150 position on the side of the base section, or more specifically, on the side of the first base layer 50, to help hold the wing portion 70 of the top layer 40 in place along the side of the base sections 50, 60.

With additional reference to FIG. 7, when the extensions 200 of the bed 170 are raised and the supports 220 are put in place the bed deck offers an expanded width. To accommodate this expansion, the wing portions 70 of the top layer 40 of mattress 20 are raised to an extended position so that they are substantially horizontal. Next, the expansion members 30 are placed on the extensions 200 beneath the wing portions 70 of the top layer 40 and beside the base layers 50, 60. The flaps 100 extending from the top layer 40 are then placed on the outside of the expansion members 30 with the flap fastener 110 on the flaps cooperating with the member fastener 120 on the expansion members to help hold the expansion members 30 in place. Additionally, the member fastener 130 on the interior side of the expansion members 30 cooperate with the base fastener 160 on the side of the base section, and more specifically on second base layer 60, to further help hold the expansion members 30 in place. As can be seen, even though expansion members 30 are employed to expand the width of the mattress 20, the sleeping surface in this configuration has no seams or creases because top layer 40 extends fully over the expansion members 30.

Having described the invention, it should be apparent that the invention successfully addresses the issues identified above, namely that it provides a seamless, smooth sleeping surface for a variable width bed in both its narrow width and its expanded width. Moreover, the present invention is both inexpensive and easy to use. Additionally, those skilled in the art will perceive improvements, changes, and modifications from the above description of the invention. Such improvements, changes and modifications within the skill of the art are intended to be covered by the appended claims. It is important, therefore, that the claims be regarded as including such equivalent constructions insofar as they do not depart from the spirit and scope of the present invention. Though some features of the invention may be claimed in dependency, each feature has merit when used independently.

What is claimed is:

1. A mattress for a variable width bed, the mattress comprising:

a top section positioned on a base section, the top section having a width greater than the width of the base section so that a wing portion of the top section is extendable beyond a side of the base section, the top section having a relief notch defined therein and positioned proximate to the side of the base section.

2. The mattress of claim 1 wherein the base section comprises a first base layer and a second base layer.

3. The mattress of claim 1 wherein the top section comprises a viscoelastic foam.

4. The mattress of claim 1 wherein the relief notch is configured to permit the wing portion of the top section to move between an extended position and a retracted position with a top surface of the top section being substantially smooth and substantially seam free.

5. The mattress of claim 4 wherein the top surface is substantially crease free.

6. The mattress of claim 1 wherein the relief notch comprises a substantially half parabolic cross section.

7. The mattress of claim 1 wherein the relief notch comprises a substantially quarter circle cross section.

8. The mattress of claim 1 wherein the relief notch extends adjacent to the side of the base section.

9. The mattress of claim 1 further comprising a top fastener coupled to the underside of the wing portion of the top section and a base fastener coupled to the side of the base section, the top and base fasteners cooperating to fasten the underside of the wing portion to the side of the base section.

10. The mattress of claim 9 wherein the top and base fasteners comprise hook and loop fasteners.

11. The mattress of claim 1 further comprising a second wing portion of the top section extendable beyond a second side of the base section.

12. The mattress of claim 1 further comprising an expansion member positionable under the wing portion to support the wing portion in an extended position.

13. The mattress of claim 12 further comprising a base fastener coupled to the side of the base section and a member fastener coupled to one side of the expansion member, the base and member fasteners cooperating to fasten the expansion member to the side of the base section.

14. A mattress for a variable width bed, the mattress comprising:

a top section over a base section, the top section having a width greater than the width of the base section so that wing portions of the top section are extendable beyond the sides of the base section to present a sleeping surface substantially without seams and having a width substantially the width of the top section, the top section having relief notches defined therein with each relief notch positioned proximate to a side of the base section so that the wing portions are foldable to present a sleeping surface substantially without seams and having a width substantially the width of the base section.

15. The mattress of claim 14 further comprising an expansion member positionable under a wing portion to support the wing portion in an extended position.

16. The mattress of claim 14 wherein the relief notch extends adjacent to the side of the base section.

17. A mattress for a variable width bed, the mattress comprising:

a top section positioned on a base section, the top section having a width greater than the width of the base section so that a wing portion of the top section is extendable beyond each side of the base section, the top section having relief notches defined therein with each relief notch extending the length of the top section and positioned proximate to the side of the base section.

18. The mattress of claim 17 wherein the relief notches are configured to permit the wing portions of the top section to move between an extended position and a retracted position with a top surface of the top section being substantially smooth and substantially seam free.

19. The mattress of claim 17 further comprising an expansion member positionable under a wing portion to support the wing portion in an extended position.

20. The mattress of claim 17 wherein the relief notches extend adjacent to a side of the base section.

* * * * *